United States Patent [19]

Deal

[11] Patent Number: 4,628,623

[45] Date of Patent: Dec. 16, 1986

[54] TURBIDITY CONTROL SYSTEM FOR DREDGE CUTTERHEADS

[76] Inventor: Troy M. Deal, 277 Trismen Ter., Orlando, Fla. 32802

[21] Appl. No.: 710,564

[22] Filed: Mar. 11, 1985

[51] Int. Cl.[4] ..... E02F 3/92

[52] U.S. Cl. ..... 37/63; 37/66; 37/195; 37/DIG. 1

[58] Field of Search ..... 37/66, DIG. 1, 63, 62, 37/195

[56] References Cited

U.S. PATENT DOCUMENTS

| | | | |
|---|---|---|---|
| 501,870 | 7/1893 | Collins | 37/66 |
| 1,106,038 | 8/1914 | Fruhling | 37/66 |
| 3,412,862 | 11/1968 | Chaplin | 210/73 |
| 3,738,029 | 6/1973 | Harmon | 37/66 |
| 3,962,803 | 6/1976 | O'Brien | 37/66 |
| 3,971,148 | 7/1976 | Deal | 37/66 |
| 4,319,782 | 3/1982 | Latimer | 37/DIG. 1 |

FOREIGN PATENT DOCUMENTS

| | | | |
|---|---|---|---|
| 242055 | 9/1969 | U.S.S.R. | 37/63 |
| 422828 | 9/1974 | U.S.S.R. | 37/63 |

OTHER PUBLICATIONS

Horizontal Auger Dredge—Mud Cat National Car Rental.

*Primary Examiner*—Clifford D. Crowder
*Attorney, Agent, or Firm*—Beaman & Beaman

[57] ABSTRACT

A turbidity control system for dredging operations wherein turbidity adjacent the dredge head is controlled by one or more operating characteristics of the dredging operation. The dredge head includes water jets for agitating, slurrying, loosening the material being removed and directing the material toward the dredge head and control apparatus regulating the water flow into the dredge head, the direction of the jets, the rate of water removal from the head, and the rate of dredge head advancement is adjusted in accord with the turbidity to permit dredging operations within acceptable environmental limits. A turbidity sensor may be mounted adjacent the dredge head to sense the extent of turbidity existing, and the sensor may be used to automatically operate the control apparatus.

15 Claims, 4 Drawing Figures

TURBIDITY CONTROL SYSTEM FOR DREDGE CUTTERHEADS

BACKGROUND OF THE INVENTION

Dredging operations require that the waterway bottom materials and spoils be disturbed and removed. Such disturbing of the waterways bottom produces turbidity, and in many instances excessive turbidity has an adverse environmental effect and standards for acceptable turbidity conditions during dredging have been established by the Department of Army, Corps of Engineers, Departments of Natural Resources and Environmental Protection Agencies responsible for dredging and marine construction operations.

In many dredging operations it is desirable to use high pressure water jets directed toward the bottom surface to be removed, wherein such jetting or agitation loosens and disintegrates the bottom material to facilitate removal by suction pumps. While dredging operations utilizing jet nozzles are capable of high volume removal of spoils and bottom material, the nature of a jetting operation produces high turbidity conditions with conventional dredging apparatus. Accordingly, in those areas wherein turbidity must be closely controlled, and with minimal tolerance, dredging operations may become excessively expensive and time consuming due to turbidity control requirements. The problem is particularly critical where the bottom sediments contain heavy metals and toxic wastes.

In my U.S. Pat. No. 3,971,148 I disclose the use of a hood having fixed and movable portions to reduce turbidity, but this apparatus does not employ jets and the relatively open cutter head apparatus is incapable of reducing the turbidity to the levels often presently required, especially at high material removing rates.

It is also known to use jet nozzles in dredging operations of the suction type as shown in U.S. Pat. Nos. 501,870 and 3,412,862, and while such disclosures show the use of water jets engaging the material to be removed prior to entering a dredge head or housing, the known prior art using jets has not been concerned with turbidity control, and to the inventor's knowledge, jet dredging apparatus is not available capable of effectively controlling turbidity while dredging at high volumes of spoil removal, particularly when dredging spoils containing matter conducive to producing high turbidity.

It is an object of the invention to provide a method and apparatus for controlling and minimizing turbidity during dredging operations.

It is another object of the invention to provide a dredging turbidity control system wherein various aspects of the dredging operation may be regulated to minimize turbidity.

A further object of the invention is to provide a suction type dredging system capable of utilizing high pressure jets to loosen and agitate the material to be dredged, and yet reduce turbidity to environmentally acceptable levels.

Another object of the invention is to provide a turbidity control system for dredging operations wherein the degree of turbidity may be automatically determined, and wherein dredge head components and operations may be controlled in accordance with the turbidity conditions to maintain turbidity within acceptable levels and permit the most efficient operation of the dredging apparatus which is environmentally permissible.

An additional object of the invention is to provide dredging apparatus mounted upon a barge utilizing a turbidity sensor wherein the sensor may automatically regulate control means for varying the pressure and volume of water jets, varying the flow area entering the dredge head, regulating the volume of water being drawn from the dredge head, and regulating the rate of advancement of the barge and head wherein dredging conditions may be optimized while maintaining turbidity within low acceptable levels.

In the practice of the invention the dredging apparatus includes a barge from which suspends a dredge head. The dredge head is of the suction type wherein a powerful pump mounted upon the barge or dredge ladder draws water and the dredged material from the head and discharges into a conduit for depositing the pumped material to a remote location.

The dredge head consists of a housing having a rear wall, an upper wall and a front face open in the direction of head advance. Preferably, the lower portion of the head is also open, and powered rotating cutter elements are mounted within the head having a plurality of rotating knives defined thereon for agitating and cutting through the water bottom material or spoils to break up the bottom material permitting the same to be drawn into the dredge head suction conduit.

At the upper region of the dredge head, a hood is pivotally mounted and positionable by a hydraulic cylinder wherein the hood extends forward of the head open face and may be pivoted toward or away from the head face to vary the flow area into the dredge head and thereby regulate the velocity and direction of the water entering the head. Further, a plurality of jet nozzles are mounted upon the forward edge of the hood which are disposed downwardly and are connected to a source of pressurized water located on the barge.

The jet nozzles discharge downwardly for agitating and breaking up the bottom material directly ahead of the dredge head, and moving the bottom material into the head. Depending upon the pivotal position of the hood, the jets are directed a greater or lesser distance in front of the dredge head, and operation of the hydraulic hood positioning power means permits close control of the positioning of the jet nozzles.

As the dredge head is closed at its rear wall, top and sides, and as the open bottom is engaging the material being removed, water may enter the head only through the front face. This flow path contrasts with that of my U.S. Pat. No. 3,971,148 which was relatively open at the rear. By limiting the water flow into the head through the front face the velocity and volume of the water entering the head can, to a significant extent, be controlled by the position of the hood, and under high turbidity conditions "closing" of the hood will confine the turbid water adjacent the head front face wherein it will be drawn into the head.

Control means are mounted upon the barge for controlling the position of the hood, the pressure of the water being supplied to the jets, the rate that water and spoils are removed from the dredge head, the rate of advancement of the barge, and other functions wherein these operations may be simultaneously or individually regulated and adjusted.

A sensor is mounted adjacent the dredge head for accurately determining the turbidity conditions existing at the head. Such a sensor is of conventional type utilizing a light source for determining the reflective characteristics of the water, and hence the degree of turbidity at any given time.

Preferably, the sensor automatically controls the aforementioned control means, and under excessive turbidity conditions, the position of the hood and jets, the amount of water being expelled from the jets, the rate of removal of the water from the head, or the rate of advancement of the barge and dredge head can be automatically regulated to produce optimum operating efficiencies within turbidity parameters.

The practice of the invention permits turbidity regulations to be met while permitting the dredging of bottom material to take place at a cost effective rate, and the invention permits the suction dredging of bottom compositions which could not heretofore be efficiently dredged within turbidity limitations.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
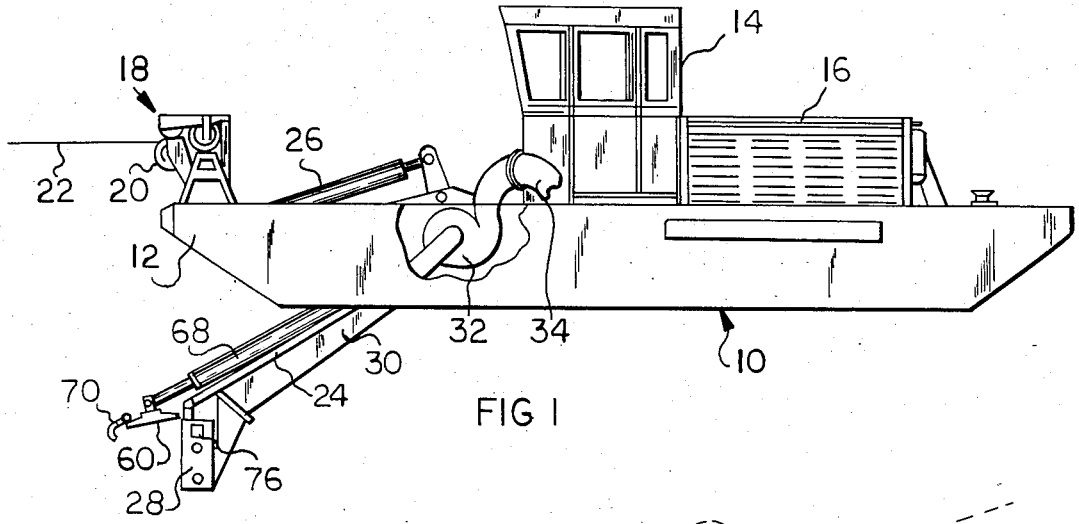
FIG. 1 is an elevational view, partially broken away, of a typical barge utilizing the apparatus practicing the inventive concepts.

With reference to FIG. 1, a barge as shown at 10 is of conventional design having a bow 12, a stern, a pilothouse 14 and a motor compartment 16. The barge includes a self-propelled cable advancing system generally represented at 18 which includes a winch 20 upon which cable 22 is wound wherein rotation of the winch will advance the barge forwardly, to the left as shown in FIG. 1, in the known manner. Propellers, not shown, may also be used with the barge for advancement purposes.

The barge 10 includes dredging apparatus suspended from the forward region of the barge which includes a ladder or arm 24 pivotally supported on the barge and adjustably elevated by hydraulic cylinder 26. At its lower end, the ladder includes the dredge head 28, and a suction conduit 30 extends from the dredge head constituting the outlet from the dredge head and the inlet for the barge main pump 32 which discharges through conduit 34 for disposal of the dredged materials to a remote location as is well known in dredging practice. The pump 32 is driven by a motor 36 mounted upon the barge.

Figure 3:
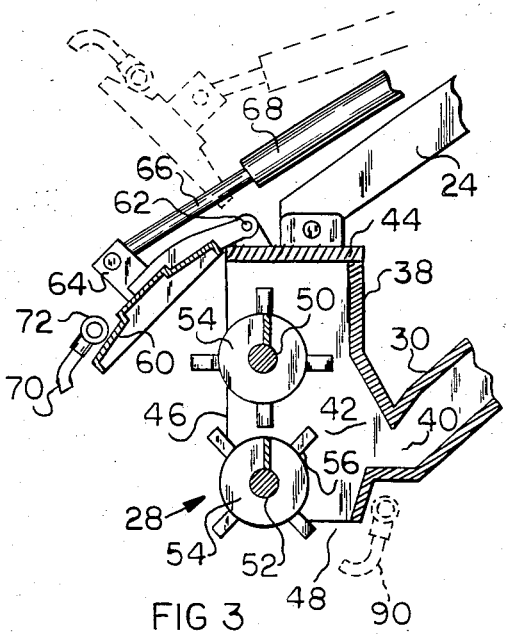
FIG. 3 is a side, elevational, sectional, detailed view of a dredge head as taken along Section III—III of FIG. 2, the hood being in a lowered position.

The dredge head 28 includes a rear wall 38, FIG. 3, which is substantially vertically oriented and includes an outlet 40 communicating with the the pump suction conduit 30. Usually, the outlet will be located centrally with respect to the lateral end plates 42 of the head.

At its upper region the dredge head is enclosed by the top plate 44, and as will be appreciated in FIG. 3, the dredge head includes a forward open face 46, and the lower portion of the head is also preferably open at 48 to permit the lower cutters to extend therebelow.

A pair of rotating shafts 50 and 52 are located within the dredge head and rotatably mounted on end plates 42 and each supports spiral cutting elements 54 and knives 56, and the shafts are rotated by hydraulic motor 58. The shafts and cutting elements are similar to those shown in my U.S. Pat. No. 3,971,148, and form no part of the present invention. As will be appreciated from FIG. 3, the knives 56 extend forward of the open face 46, and below the head bottom opening 48 wherein the knives will effectively engage, agitate and break up bottom material and spoils against which the dredge head is advanced.

Figure 2:
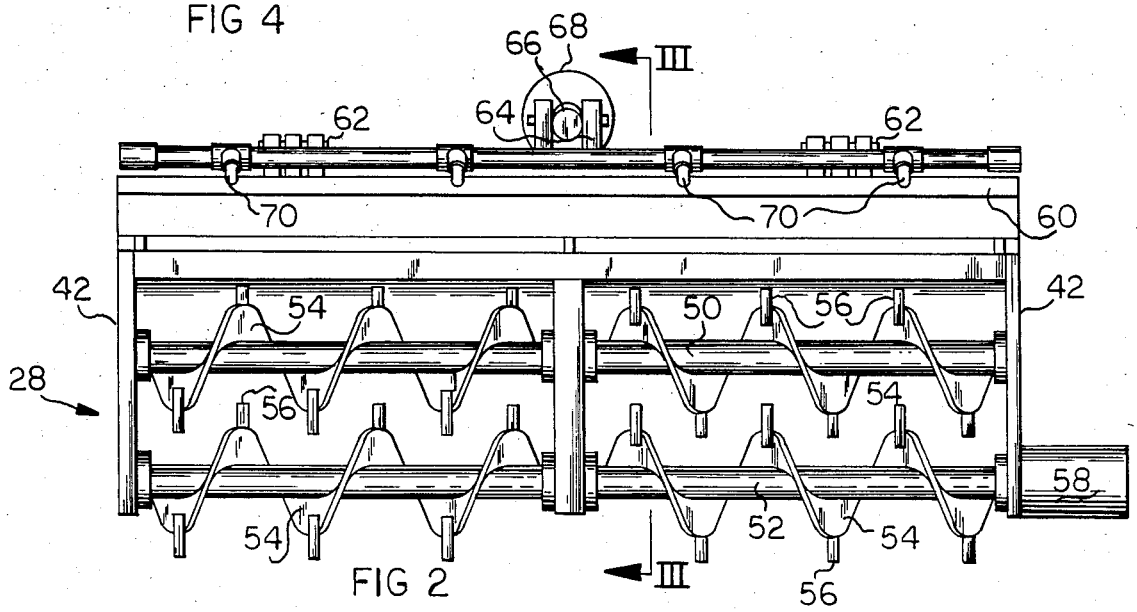
FIG. 2 is a front elevational view of the dredge head illustrating the cutters, and the hood being in an elevated horizontal position.

A hood 60 is pivotally mounted upon the head top plate 44 upon pivots 62 and the hood is of a solid configuration extending the width of the head as defined by the head end plates 42, FIG. 2. The hood 60 includes a bracket 64 pivotally receiving the piston 66 of hydraulic cylinder 68, and the upper end of the cylinder is attached to the dredge head support ladder 24 whereby extension and retraction of the piston 66 pivots the hood 60 relative to the dredge head, the upper position being represented in dotted lines in FIG. 3 and in the lower position in full lines. In FIG. 2 the hood is illustrated in a substantially horizontal position.

A plurality of jet nozzles 70 are mounted adjacent the forward edge of the hood 60 and communicate with a manifold conduit 72 extending the hood width. The manifold conduit is attached to a pump 74 mounted upon the barge by an appropriate flexible conduit, not shown, and the nozzles are so mounted on the hood that as the hood is pivoted between the positions shown in FIG. 3, the direction of discharge from the nozzles may be accurately regulated. When the hood is pivoted to the lowermost position shown in full lines in FIG. 3, the discharge of the nozzles will be directed closest to the dredge head open face 46, and when the hood is pivoted to the upper dotted line position, the discharge from the nozzles will be substantially parallel to and forward of the head.

A turbidity sensor 76 is mounted adjacent the dredge head 28, and in the drawings is shown as being mounted upon the left end plate 42. This sensor or transducer may be of known construction such as Model No. 2100-A Turbidmeter, made by Hach Instrument Co. wherein the reflective characteristics of the surrounding water are evaluated and an electric signal is produced of a value determined by the degree of turbidity existing. Turbidity is measured in Nephelometer units and the particular type of turbidity sensor does not constitute a portion of the invention, it only is required that the sensor 76 provide an electric signal capable of indicating the degree of turbidity existing adjacent the dredge head.

Figure 4:
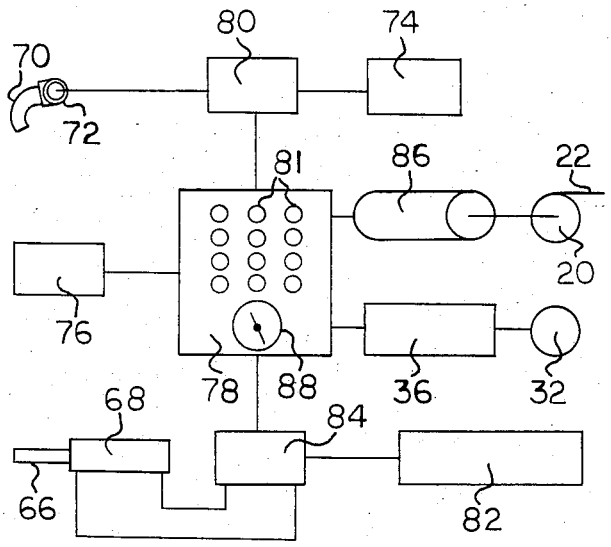
FIG. 4 is a schematic diagram illustrating the controlled components of a dredge in accord with the invention.

Various components of the barge 10 are controlled by the electrical controller 78, FIG. 4, and preferably, the controller is both of the manual and automatic type wherein controls 81 permit manual operation of the functions described below, or the controller 78 may be placed under control of the signals being received from the turbidity sensor 76.

The pump 74 for the jet nozzles 70 is controlled by valve 80 which is regulated by controller 78. Hydraulic pump 82 controls the position of the hood 60 through hydraulic cylinder 68 and valve 84 which is under the dictates of the controller 78. The motor 86 which drives the barge advance winch 20 is also under the operation of controller 78, and likewise the motor 36 driving the primary suction pump 32 is regulated by the controller 78.

In operation, the dredge head 28 will be lowered as shown in FIG. 1, and the winch motor 86 energized to advance the barge and dredge head against the material to be dredged. Initially, the nozzle pump 74 will be energized, as will the motor 58 for rotating the cutter shafts 50 and 52, and the hood 60 may initially be in a relatively low position wherein the water jets from nozzles 70 are engaging the bottom material close to the dredge head open face.

The amount of turbidity produced during dredging will vary considerably depending on the composition of the bottom material or spoils. Loose flaking material consisting of organic particles will quickly produce high turbidity levels, while relatively clean hard sand does not generate turbidity as quickly. During dredging, if under manual control, the operator will observe the output of the turbidity sensor 76 as indicated on gage 88, and as the turbidity level approaches unacceptable conditions, the operator may make adjustments to lower the turbidity level. For instance, extending of the piston 66 will direct the jet nozzles 70 downwardly for engagement of the jetted water closer to the open face 46 of the dredge head. This movement of the hood simultaneously "restricts" the flow area from behind and above into the dredge head face 46 producing higher velocities in the water passing under the hood and entering the dredge head from the sides. Such higher velocities and closer proximity of the jetted water will quickly control the turbidity being produced by the jets, and usually, lower the turbidity level to an acceptable condition.

If the pivoting of the hood 60 and the adjustment of the direction of jet discharge does not adequately lower turbidity, the rate of withdrawal of water from the dredge head 28 may be increased by increasing the output of pump 32 by increasing the output of pump motor 36. Further, turbidity levels can usually be lowered by reducing the rate of advancement of the barge and dredge head into the material being removed by slowing motor 86 as this reduction in the advancement rate will usually lower the ratio of agitated material being dislodged from the bottom to the ratio of water being withdrawn from the dredge head.

Additionally, as the controller 78 controls the valve 80 to the jet nozzles 70, the volume and pressure of water being discharged may readily be controlled, and turbidity conditions regulated by controlling the rate of discharge from the nozzles.

Under some soil conditions, the use of the jet nozzles 70 may not be required as the cutter shaft elements 54 and knives 56 may adequately agitate and comminute the bottom solids to permit efficient dredging. In such instance controlling the position of the hood 60, alone, may permit efficient dredging within turbidity limitations.

It is within the concept of the invention to automatically permit the turbidity sensor 76 to control the position of the hood 60, the rate of barge advancement, the rate of water removal from the dredge head and the characteristics of the jet nozzle discharge, and under automatic control the sensor 76 will provide a signal to the controller indicating the turbidity conditions and the controller may automatically make such adjustments as most effectively reduce the turbidity to acceptable levels for the particular conditions.

It is to be appreciated that modifications to the inventive concepts may be apparent to those skilled in the art without departing from the spirit and scope of the invention. For instance, jets may be added to the end plates 42 or lower regions of the dredge head 28, as shown in dotted lines at 90, and controlled by controller 78 wherein such jets may improve dredging conditions within acceptable turbidity levels, and the versatility of operation of the invention permits a wide variation of adjustment of dredging factors which will permit dredging under acceptable turbidity levels for a wide variety of bottom material conditions.

I claim:

1. A method for controlling turbidity during dredging by a suction type dredge head having a closed configuration defined by rear, upper and side walls and having an open face and a suction outlet, a hood selectively movable with respect to the open face to vary the area thereof, and agitating means within the dredge head adjacent the head open face, comprising the steps of:

(a) translating the dredge head in a direction toward the material being dredged wherein the dredged material approaches the head open face, (b) agitating the dredged material adjacent the head open face to loosen the dredged material to facilitate the disposal and pumping thereof through the head suction outlet, (c) sensing the turbidity existing adjacent the dredge head, (d) controlling the turbidity caused by the dredged material in accord with the sensing thereof by positioning the hood relative to the dredge head open face to vary the area of the open face to control the velocity of water movement into the dredge head open face to maintain the degree of turbidity adjacent the dredge head to a predetermined value, and (e) removing the agitated dredged material entering the dredge head open face through the head suction outlet.

2. The method of controlling turbidity during dredging as in claim 1 wherein:

(a) agitating the dredged material includes the step of forcing a jet of water against the material being dredged.

3. The method of controlling turbidity during dredging as in claim 2 wherein:

(a) controlling the turbidity caused by the dredged material includes the step of directing the jet of water against the material being dredged at a specific location relative to the dredge head open face.

4. The method of controlling turbidity during dredging as in claim 2 wherein:

(a) controlling the turbidity caused by the dredged material includes the step of varying the characteristics of the jet of water.

5. The method of controlling turbidity during dredging as in claim 4 wherein:

(a) varying the characteristics of the jet of water includes the step of varying the volume of water jet.

6. The method of controlling turbidity during dredging as in claim 4 wherein:

(a) varying the characteristics of the jet of water includes the step of varying the pressure of the water jet.

7. The method of controlling turbidity during dredging as in claim 4 wherein a plurality of jets of water are forced against the material being dredged and wherein:

(a) varying the characteristics of the jet of water includes the step of varying the number of jets of water and the spacing between adjacent jets.

8. The method of controlling the turbidity during dredging as in claim 1 wherein:

(a) controlling the turbidity caused by the dredged material in accord with the sensing of the turbidity includes the step of varying the rate of translation of the dredge head in a direction toward the material being dredged.

9. The method of controlling the turbidity during dredging as in claim 1 wherein:

(a) controlling the turbidity caused by the dredged material including the step of varying the rate of removal of the dredged material entering the dredge head through the suction outlet to reduce turbidity adjacent the head open face.

10. Apparatus for controlling turbidity during dredging wherein a barge includes a suspended dredge head having an open face, upper and lower face regions, and a sucton outlet, a pump mounted upon the barge in communication with the suction outlet and having a discharge conduit, the improvement comprising, agitating means mounted upon the dredge head adapted to agitate and displace the material to be dredged adjacent the head, sensing means located adjacent the dredge head sensing the degree of turbidity within the water adjacent the head, and control means controlling said agitation means whereby said agitation means may be regulated in accord with said sensing means to control the degree of turbidity adjacent the dredge head.

11. In apparatus for controlling the turbidity during dredging as in claim 10, said agitating means comprising a plurality of jet nozzles mounted upon the dredge head, and a source of pressurized water in communication with said nozzles.

12. In apparatus for controlling turbidity during dredging as in claim 11, a hood pivotally mounted upon the dredge head upper region adjacent the head open face regulating and varying the water flow area into the head open face, motor means connected to said hood pivotally positioning said hood upon the head, said jet nozzles being mounted upon said hood.

13. In apparatus for controlling turbidity during dredging as in claim 12, said sensing means being connected to and controlling said control means whereby said sensing means automatically controls said agitation means, said source of pressurized water communicating with said nozzles and said motor means being connected to and controlled by said control means.

14. In apparatus for controlling turbidity during dredging as in claim 12, barge propelling means mounted on said barge, said propelling means being connected to and controlled by said control means, said sensing means being connected to and automatically controlling said control means whereby the rate of barge and dredge head movement is controlled by the degree of turbidity adjacent the dredge head.

15. In apparatus for controlling turbidity during dredging as in claim 10, the barge pump in communication with the suction outlet being connected to and controlled by said control means, said sensing means being connected to and automatically controlling said control means whereby the operation of the barge pump is controlled by the degree of turbidity adjacent the dredge head.

* * * * *